United States Patent [19]

Tanaka et al.

[11] Patent Number: 5,008,232

[45] Date of Patent: Apr. 16, 1991

[54] THERMAL TRANSFER DYE DONATING MATERIAL

[75] Inventors: Mitsugu Tanaka; Seiiti Kubodera, both of Kanagawa, Japan

[73] Assignee: Fuji Photo Film Co., Tokyo, Japan

[21] Appl. No.: 461,893

[22] Filed: Jan. 8, 1990

[30] Foreign Application Priority Data

Jan. 9, 1989 [JP] Japan ..... 1-2468

[51] Int. Cl.[5] ..... B41M 5/035; B41M 5/26

[52] U.S. Cl. ..... 503/227; 8/471; 428/195; 428/484; 428/488.1; 428/913; 428/914

[58] Field of Search ..... 8/471; 428/195, 913, 428/914, 484, 488.1; 503/227

[56] References Cited

U.S. PATENT DOCUMENTS 4,873,220 10/1989 Kubodera et al. ..... 503/227

*Primary Examiner*—Bruce H. Hess

*Attorney, Agent, or Firm*—Sughrue, Mion, Zinn, Macpeak & Seas

[57] ABSTRACT

A thermal transfer dye donating material, comprising a color material layer formed on a support, said color material layer containing a dye represented by the general formula (I) below:

(I)

wherein $Q^1$ is an atomic group having at least one nitrogen atom and forming a five- to seven-membered nitrogen-containing heterocycle together with the carbon atoms to be bonded; $R^1$ is an acyl group, an alkoxycarbonyl group, an aryloxycarbonyl group, an aminocarbonyl group, or a sulfonyl group; $R^2$ is a hydrogen atom or an alkyl group; $R^3$ to $R^7$ are independently a hydrogen atom, an alkyl group, an alkoxy group, or a halogen atom; $X^1$ and $X^2$ are independently an alkylene group; $Y^1$ is an alkoxy group, a halogen atom, an acylamino group, an alkoxycarbonyl group, an alkoxycarbonyloxy group, a cyano group, an alkoxycarbonylamino group, an aminocarbonylamino group, a carbamoyl group, an acyloxy group, an acyl group or a hydroxy group; $Y^2$ is a hydrogen atom or groups defined above as $Y^1$.

10 Claims, No Drawings

THERMAL TRANSFER DYE DONATING MATERIAL

FIELD OF THE INVENTION

The present invention relates to a thermal transfer dye donating material.

BACKGROUND OF THE INVENTION

Thermal transfer printing, electrophotography, ink-jet printing, etc. are comprehensively investigated in connection with color hard copy technology. Among them, thermal transfer color donation has many advantages in comparison with other methods in view of the ease of maintenance and operation of an apparatus, the low prices of the apparatuses and the expendables, etc.

The thermal transfer printing is classified into two methods: (1) a method in which a thermal transfer dye donating material having a thermally fusible ink layer formed on a base film is heated by a thermal head to melt the ink, and thus recording is conducted on a thermally transferred image receiving material for thermal transfer printing; and (2) a method in which a thermal transfer dye donating material having a color material layer formed on a base film and containing a thermally migrating dye is heated by a thermal head to transfer thermally the dye onto the image receiving material for thermal transfer printing. The latter method, namely the thermal migration transfer printing is especially advantageous in full color recording in high quality because the transfer concentration of the dye can be varied by varying the energy given to a thermal head, thus facilitating gradation recording. The thermally migrating dye, however, is restricted in many respects, and few dyes can satisfy all the characteristics required.

The characteristics required are, for example, spectrographic properties suitable for color reproduction, high thermal migration, high light-fastness, high heat stability, high resistance to various chemicals, resistance to sharpness deterioration, resistance to retransfer, ease of the synthesis, ease of preparation of the thermal transfer dye donating material, and so on. Accordingly, the development of cyan dyes satisfying these requirements are especially desired.

A variety of cyan dyes are proposed. Among them, indoaniline type dyes are relatively satisfactory and are described in JP-A-60-239289, JP-A-61-22993, JP-A-61-268493, JP-A-62-191191, and JP-A-63-91287. (the term "JP-A" as used herein means an "unexamined published Japanese patent application") Nevertheless, these dyes cannot satisfy all the requirements of spectrographic absorption suitable for color reproduction, transfer concentration, light-fastness and retransfer of images.

SUMMARY OF THE INVENTION

The present invention provides a thermal transfer dye donating material which does not suffer from the disadvantages described above.

The present invention provides a thermal transfer dye donating material comprising a color material layer formed on a support, said color material layer containing a dye represented by the general formula (I) below:

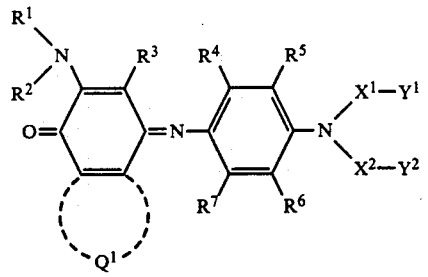

(I)

wherein $Q^1$ is an atomic group having at least one nitrogen atom and forming a five- to seven-membered nitrogen-containing heterocycle together with the carbon atoms to be bonded; $R^1$ is an acyl group, an alkoxycarbonyl group, an aryloxycarbonyl group, an aminocarbonyl group, or a sulfonyl group; $R^2$ is a hydrogen atom or an alkyl group; $R^3$ to $R^7$, which may be the same or different, are independently a hydrogen atom, an alkyl group, an alkoxy group, or a halogen atom; $X^1$ and $X^2$, which may be the same or different, are independently an alkylene group; $Y^1$ is an alkoxy group, a halogen atom, an acylamino group, an alkoxycarbonyl group, an alkoxycarbonyloxy group, a cyano group, an alkoxycarbonylamino group, an aminocarbonylamino group, a carbamoyl group, an acyloxy group, an acyl group or hydroxy group; $Y^2$ is a hydrogen atom or groups defined above as $Y^1$.

DETAILED DESCRIPTION OF THE INVENTION

The dye represented by the above Formula (I) is explained below in detail.

The group represented by $Q^1$ is an atomic group having at least one nitrogen atom and forming a five- to seven-membered nitrogen-containing heterocycle together with the carbon atoms to be bonded. The bivalent group forming the nitrogen-containing ring with a nitrogen atom is exemplified by a bivalent amino group, an ether group, a thioether group, an alkylene group, a vinylene group, an imino group, a sulfonyl group, a carbonyl group, an arylene group, a bivalent heterocycle group, and a combination of the above groups, which may have further substituents.

A preferable example of $Q^1$is

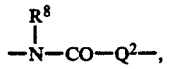

wherein $Q^2$ is exemplified by a bivalent amino group, an ether group, a thioether group, an alkylene group, a vinylene group, an imino group, a sulfonyl group, a carbonyl group, an arylene group, a bivalent heterocycle group, and a combination of the above groups, which may have further substituents.

The group represented by $R^8$ includes: a hydrogen atom; alkyl groups, which may be substituted and preferably have 1 to 10 carbon atoms, such as methyl, ethyl, isopropyl, butyl, cyclohexyl, 2-methoxyethyl, benzyl, and allyl; aryl groups, which may be substituted and preferably have 6 to 12 carbon atoms, such as phenyl, and p-tolyl; and heterocyclic groups, which may be substituted and preferably have 3 to 10 carbon atoms, such as 2-pryidyl, 2-imidazolyl, and 2-furyl. More preferably $R^8$ is a hydrogen atom.

The $R^1$ acyl groups includes: alkylcarbonyl groups, which may be substituted preferably have 1 to 10 carbon atoms, such as formyl, acetyl, propionyl, isobutyryl, hexahydrobenzoyl, pivaloyl, trifluoroacetyl, heptafluorobutyryl, chloropropionyl, cyanoacetylamino, and phenoxyacetylamino; vinylcarbonyl groups, which may be substituted and preferably have 3 to 10 carbon atoms, such as acryloyl, methacryloyl, and crotonoyl; arylcarbonyl groups, which may be substituted and preferably have 7 to 15 carbon atoms, such as benzoyl, p-tolyl, pentafluorobenzoyl, o fluorobenzoyl, m-methoxybenzoyl, p-trifluoromethylbenzoyl, 2,4-dichlorobenzoyl, p-methoxycarbonylbenzoyl, and 1-naphthoyl; and heterylcarbonyl groups, which may be substituted and preferably have 5 to 13 carbon atoms, such as picolinoyl, nicotinoyl, pyrrol-2-carbonyl, thiophene-2-carbonyl, furoyl, and piperidine-4-carbonyl.

The alkoxycarbonyl groups represented by $R^1$ may be substituted and preferably have 2 to 10 carbon atoms. Examples thereof include a methoxycarbonyl group, an ethoxycarbonyl group, an isopropoxycarbonyl group, a butoxycarbonyl group, a methoxyethoxycarbonyl group, a cyclopentyloxycarbonyl group, a cyclohexyloxycarbonyl group, a chloroethoxy carbonyl group, a cyanoethoxycarbonyl group, a benzyloxycarbonyl group, and an allyloxycarbonyl group.

The aryloxycarbonyl groups represented by $R^1$ may be substituted and preferably have 7 to 16 carbon atoms. Examples thereof include a phenoxycarbonyl group, a p-tolylcarbonyl group, a p-methoxyphenoxycarbonyl group, a m-chlorophenoxycarbonyl group, a 2,4 -dimethylphenoxycarbonyl group, and a p-ethylphenoxycarbonyl group.

The aminocarbonyl groups represented by $R^1$ may be substituted and preferably have 1 to 11 carbon atoms. Examples thereof include a methylaminocarbonyl group, a dimethylaminocarbonyl, an isopropylaminocarbonyl group, a butylaminocarbonyl group, a methoxyethylaminocarbonyl group, an anilinocarbonyl group, a thiazolylaminocarbonyl group, and a benzothiazolylaminocarbonyl group.

The sulfonyl groups represented by $R^1$ have preferably 1 to 10 carbon atoms. Examples thereof include a methanesulfonyl group, an ethanesulfonyl group, an isobutanesulfonyl group, a phenylsulfonyl group, and a p-methoxyphenylsulfonyl group.

A preferable $R^1$ is an acyl group having 2 to 7 carbon atoms.

The group represented by $R^2$ includes a hydrogen atom and alkyl groups, which may be substituted and preferably have 1 to 12 carbon atoms, such as methyl, ethyl, isopropyl, butyl, cyclohexyl, 2-methoxyethyl, benzyl, and allyl.

Preferable as $R^2$ is a hydrogen atom.

The groups represented by $R^3$ to $R^7$, which may be the same or different, are independently a hydrogen atom; alkyl groups which are the same as those mentioned as to $R^2$; alkoxy groups, which may be substituted and preferably have 1 to 12 carbon atoms, such as methoxy, ethoxy, isopropoxy, butoxy, methoxyethoxy, cyclopentyloxy, cyclohexyloxy, benzyloxy, 2-cyanoethoxy, 2-chloroethoxy, and allyloxy; and halogen atoms including fluorine, chlorine, and bromine atoms.

Preferable as $R^3$, $R^5$, $R^6$, and $R^7$ is a hydrogen atom. Preferable as $R^4$ are a hydrogen atom, a methyl group, an ethyl group, a methoxy group, and an ethoxy group.

The groups represented by $X^1$ and $X^2$, which may be the same or different, are independently exemplified by a straight, branched or cyclic alkylene groups, which preferably have 1 to 6 carbon atoms, such as methylene, ethylene, isopropylene, and cyclohexylene.

Preferable as $X^1$ and $X^2$ is an ethylene group.

The group represented by $Y^1$ includes: alkoxy groups, which may be substituted and preferably have 1 to 6 carbon atoms, such as methoxy, ethoxy, isopropoxy, and methoxyethoxy; halogen atoms including fluorine, chlorine, and bromine atoms ; acylamino groups, which may be substituted and preferably have 1 to 7 carbon atoms, such as acetylamino, propionylamino, isobutyrylamino, and benzoylamino; alkoxycarbonyl groups, which may be substituted and preferably have 2 to 6 carbon atoms, such as methoxycarbonyl and ethoxycarbonyl; alkoxycarbonyloxy groups, which may be substituted and preferably have 2 to 6 carbon atoms, such as methoxycarbonyloxy, and ethoxycarbonyloxy; a cyano group; alkoxycarbonylamino groups, which may be substituted and preferably have 2 to 6 carbon atoms, such as methoxycarbonylamino, and ethoxycarbonylamino; aminocarbonylamino groups, which may be substituted and preferably have 2 to 6 carbon atoms, such as methylaminocarbonylamino, and dimethylaminocarbonylamino; carbamoyl groups, which may be substituted and preferably have 2 to 6 carbon atoms, such as methylcarbamoyl, dimethylcarbamoyl, and butylcarbamoyl; acyloxy groups, which may be substituted and preferably have 2 to 7 carbon atoms, such as acetyloxy, propionyloxy, isobutyryloxy, and benzoyloxy; acyl groups, which may be substituted and preferably have 2 to 6 carbon atoms, such as acetyl; and a hydroxy group.

Preferable as $Y^1$ are alkoxy groups having 1 to 4 carbon atoms, alkoxycarbonyl groups and acyloxy groups.

The groups represented by $Y^2$ are a hydrogen atom and the groups represented by $Y^1$ as mentioned above.

Preferable as $Y^2$ is a hydrogen atom.

Of the dyes represented by the general formula (I), the dyes represented by the general formula (II) below are preferable.

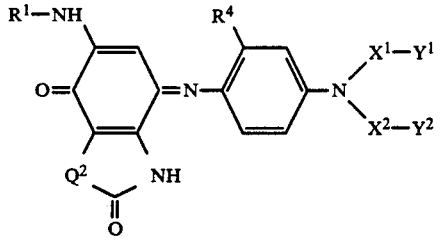

(II)

wherein $R^1$, $R^4$, $X^1$, $X^2$, $Y^1$, $Y^2$, and $Q^2$ are the same as defined above.

In the general formula (II), particularly preferable as $Q^2$ is:

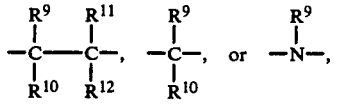

wherein $R^9$ to $R^{12}$ may be the same or different and represent independently a hydrogen atom or an alkyl group having 1 to 4 carbon atoms, preferably, $R^9$ and $R^{10}$ may be the same or different and represent independently a hydrogen atom, a methyl group or an ethyl group and $R^{11}$ and $R^{12}$ represent independently a hydrogen atom.

Specific examples of the dyes of the present invention represented by the general formula (I) are shown below:

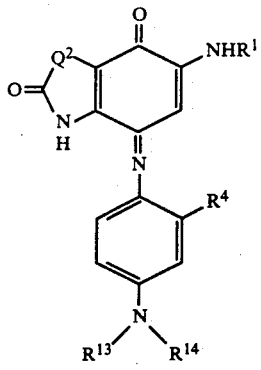

| No. | $Q^2$ | $R^1$ | $R^4$ | $R^{13}$ | $R^{14}$ |
|---|---|---|---|---|---|
| 1 | $-CH_2-C(CH_3)_2-$ | $-COCF_3$ | $-CH_3$ | $-CH_2CH_2-OCH_3$ | $-C_2H_5$ |
| 2 | " | " | " | $-CH_2CH_2OC_2H_5$ | " |
| 3 | " | " | " | $-CH_2CH_2OCH_3$ | $-CH_2CH_2OCH_3$ |
| 4 | " | " | " | $-CH_2CH_2OCH_2CH_2OCH_3$ | $-C_3H_7$ |
| 5 | " | " | " | $-CH_2CH_2OC_4H_9$ | $-C_4H_9$ |
| 6 | " | " | " | $-CH_2CH_2COOCH_3$ | $-C_2H_5$ |
| 7 | " | " | " | $-CH_2CH_2COOC_2H_5$ | " |
| 8 | " | " | " | $-CH_2COOC_3H_7$ | $-CH_3$ |
| 9 | " | $-COC_3F_7$ | " | $-CH_2CH_2COOC_2H_5$ | $-C_2H_5$ |
| 10 | " | " | $-C_2H_5$ | " | " |
| 11 | " | $-COCF_3$ | $-CH_3$ | $-CH_2CH_2OH$ | " |
| 12 | $-CH_2-C(CH_3)_2-$ | $-COCF_3$ | $-CH_3$ | $-CH_2CH_2OCOCH_3$ | $-C_2H_5$ |
| 13 | " | " | $-OCH_3$ | $-CH_2CH_2CN$ | " |
| 14 | " | " | $-CH_3$ | $-CH_2CH_2NHCOCH_3$ | " |
| 15 | " | " | " | $-CH_2CH_2OCOOCH_3$ | " |
| 16 | " | " | " | $-CH_2CH_2NHCOOCH_3$ | " |
| 17 | " | 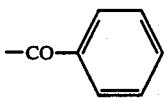 | $-OC_2H_5$ | $-CH_2CH_2OCOCH_3$ | $-CH_2CH_2OCOCH_3$ |
| 18 | " | $-COCH_3$ | " | $-CH_2CH_2Cl$ | $-CH_2CH_3$ |
| 19 | $-CH_2-C(CH_3)_2-$ | 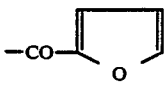 | $-CH_3$ | $-CH_2CH_2OCH_3$ | $-CH_2CH_3$ |
| 20 | $-CH_2-C(CH_3)_2-$ | 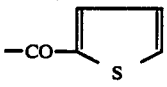 | $-CH_3$ | $-CH_2CH(OH)-C_2H_5$ | $-CH_2CH_3$ |
| 21 | " | 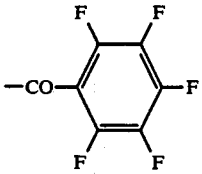 | H | $-CH_2CH_2OH$ | " |
| 22 | " | $-COOCH_3$ | $-OCH_3$ | " | " |

-continued
| | | | | | |
|---|---|---|---|---|---|
| 23 | " | $-COCH(CH_3)_2$ | " | " | " |
| 24 | " | $-COC_4H_9$-t | " | $-CH_2CH_2OCH_3$ | " |
| 25 | " | $-SO_2CH_3$ | $-CH_3$ | " | " |
| 26 | $-C(CH_3)_2-$ | $-COCF_3$ | $-CH_3$ | $-CH_2CH_2OCH_3$ | " |
| 27 | " | 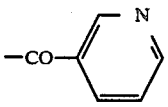 | " | $-CH_2COOC_2H_5$ | " |
| 28 | " | $-COC_2H_5$ | " | " | " |
| 29 | $-C(C_2H_5)(CH_3)-$ | $-COC_3F_7$ | " | $-CH_2CONHC_3H_7$ | $C_3H_7$ |
| 30 | $-C(C_2H_5)(CH_3)-$ | $-COCF_3$ | $-CH_3$ | $-CH_2CH_2COOC_2H_5$ | $C_2H_5$ |
| 31 | $-CH(CH_3)-$ | " | " | " | " |
| 32 | $-CH_2-$ | " | " | $-CH_2CH_2OCH_3$ | " |
| 33 | $-CH_2CH_2-$ | " | " | " | " |
| 34 | $-CH=CH-$ | " | " | " | " |
| 35 | $-NH-$ | " | " | " | " |
| 36 | $-N(C_2H_5)-$ | " | " | " | " |
No. 37
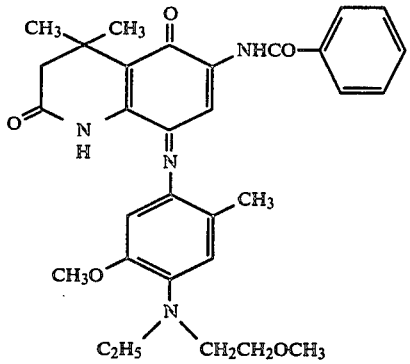
No. 38
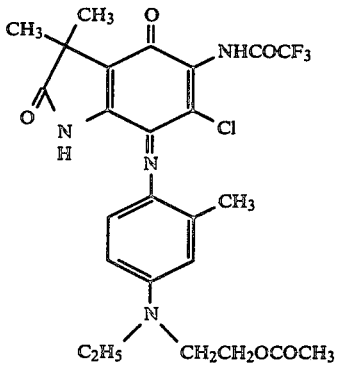

-continued

No. 39

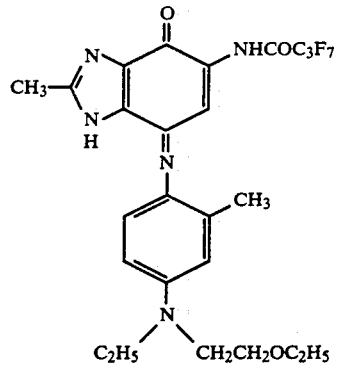

No. 40

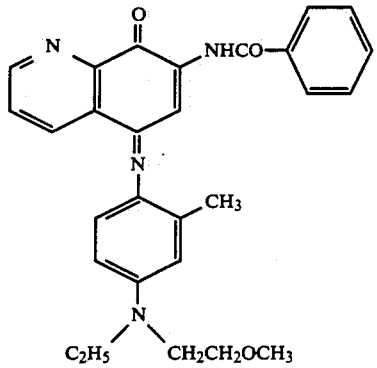

The dye of the present invention is synthesized by oxidative coupling of

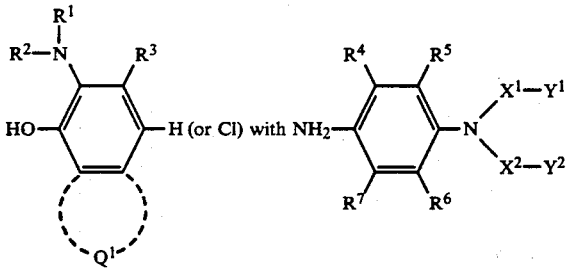

in the presence of a base.

The example of the synthesis is shown below.

SYNTHESIS OF DYE NO. 1

3.8 g of a compound represented by the structural formula below, 7.5 g of 2-methyl-4-(N-ethyl-N-acetoxyethylamino)aniline-2p-toluenesulfonate, 200 ml of ethyl acetate, 90 ml of ethanol, and 150 ml of an aqueous solution containing 17 g of sodium carbonate were combined and agitated with ice cooling.

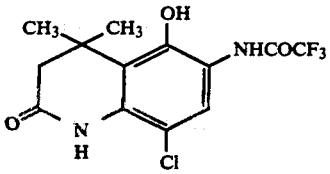

Thereto, 25 ml of an aqueous solution containing 3.1 of ammonium persulfate was added. After one hour of reaction, the two phases were separated. The ethyl acetate phase was washed with water twice and then concentrated to a volume of 10 ml. Thereto 50 ml of methanol and 5 ml of water were added to crystallize out a product, which was collected by filtration and washed with methanol to give 4.1 g of the product having a melting point of 131° to 132° C.

The thermal transfer dye donating material of the present invention is characterized by the use of a specific dye as mentioned above. In a first embodiment, the color material layer for thermal transfer printing comprises a thermally migrating dye and a binder resin. In this embodiment, the thermal transfer dye donating material can be prepared in such a manner that the dye of the present invention and a binder resin are dissolved or dispersed in a suitable solvent to provide a coating solution. The coating solution is applied on to one face of a support in an amount to give a dry thickness of e.g., 0.2 to 5.0 μm, preferably 0.4 to 2.0 μm, and then dried to form a color material layer for thermal transfer printing.

The binder resin employed with the abovementioned dye may be any known binder resin for such uses and is selected usually from those having a high heat resistance and yet not preventing the migration of the dye under heating. Examples are polyamide resins, polyester resins, epoxy resins, polyurethane resins, polyacrylic resins (e.g., polymethyl methacrylate and polyacrylamide) a nd vinyl resins ( e.g., polyvinylpyrrolidones), polyvinyl chloride resins (e.g., vinyl chloride-vinyl acetate copolymers), polycarbonate resins, polysulfones, polyphenylene oxides, cellulose resins (e.g., methylcellulose, ethylcellulose, carboxymethylcellulose, cellulose acetate hydrogen phthalate, cellulose acetate, cellulose acetate propionate, cellulose acetate butyrate, cellulose triacetate, etc.), polyvinyl alcohol resins (e.g., polyvinyl alcohol, partially saponified polyvinyl alcohol such as polyvinylbutyral, etc.), petroleum resins, rosin derivatives, coumarone indene resins, terpene resins, novolak type phenol resins, polystyrene resins, polyolefin resins (e.g., polyethylenes and polypropylenes). A preferable example is polyvinylbutyral resin.

Such a binder resin is employed preferably in an amount of approximately 50 to 600 parts by weight per 100 parts by weight of the dye.

The ink solvent for dissolving or dispersing the above dye and the binder resin in the present invention may be any of known ink solvents. Specific examples are water; alcohols such as methanol, ethanol, isopropanol, butanol, and isobutanol; esters such as ethyl acetate and butyl acetate; ketones such as methyl ethyl ketone, methyl isobutyl ketone, and cyclohexanone; aromatic hydrocarbons such as toluene, xylene, and chlorobenzene; halogenated hydrocarbons such as dichloromethane, trichloroethane, and chloroform; N,N-dimethylformamide, N-methylpyrrolidone, dioxane, tetrahydrofuran; cellosolves such as methylcellosolve and ethylcellosolve; and mixtures of the above-mentioned solvents. It is important to select a ink solvent which sufficiently dissolves or disperses the dye in more than the required concentration and the binder resin. For example, the ink solvent is preferably used in an amount of approximately 9 to 20 times the total amount of the dye and the binder.

Various film hardening agents can be used for the color material layer of the thermal transfer dye donting material in the present invention.

The film hardening agents disclosed, for example, in JP-A 61-199997 and JP-A 58-215398 can be used for polymers soluble in organic solvents. Isocyanate based film hardening agents are more preferably used for polyester resins.

The film hardening agents disclosed, for example, in column 41 of U.S. Pat. No. 4,678,739, JP-A-59-116655, JP-A-62-245261 and JP-A-61-18942 can be used for water soluble polymers. More specifically aldehyde based film hardening agents (for example, formaldehyde), aziridine based film hardening agents, epoxy based film hardening agents:

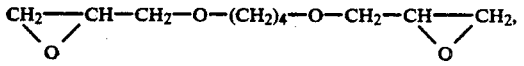

vinyl sulfone based film hardening agents (for example, N,N'-ethylenebis(vinylsulfonylacetamido)ethane), N-methylol based film hardening agents (for example, dimethylol urea) or polymeric film hardening agents (the compounds disclosed, for example, in JP-A-62-234157) can be used.

The dye of the present invention may be used either independently or in combination with known dyes.

The dye may be combined with a known discoloration-preventing agent.

The material of the support for constructing the thermal transfer dye donating material of the present invention may be any of the known materials which have a certain degree of heat resistance and strength. The support may have a thickness of 0.5 to 50 μm, preferably 3 to 10 μm. The material for the support is exemplified by paper, converted paper, polyesters such as polyethylene terephthalate, polyamides, polycarbonate, glassine paper, condenser paper, cellulose ester, fluoropolymers, polyethers, polyacetals, polyolefins, polyimides, polyphenylene sulfides, polypropylenes polystyrenes, allophanes, and polyimides. Particularly preferable are polyester films.

The ink (coating composition for dye donating material) prepared by dissolving or dispersing the dye and the binder resin in the ink solvent in the present invention may be applied on a base film, for example, by use of a reverse roll coater, a gravure coater, a microgravure coater, a rod coater, an air doctor coater, and a wire bar.

The dye donating materials for thermal transfer printing as mentioned above are useful by themselves. Additionally, an anti-sticking layer, or a releasing layer may be provided on the surface of the dye-carrying layer, whereby sticking of the dye donating material with a thermally transferred image receiving material is prevented, thus allowing the higher thermal transfer printing temperature to give more excellent image.

An anti-sticking inorganic powders (such as silica powder, etc.) dispersed on the surface of the dye-carrying layer are effective in releasing and preventing from sticking. The releasing layer may also be formed in a thickness of 0.01 to 5 μm, preferably 0.05 to 2 μm from a resin having releasing property such as a silicone polymer, an acrylic polymer, and a fluoropolymer.

The aforementioned inorganic powders or the releasing polymers are also effective in the dye-carrying layer.

Further, a heat resistant layer may also be provided on the surface of the thermal transfer dye donating material of the present invention for the purpose of avoiding an adverse hat effect from the thermal head.

A dye-barrier layer composed of a hydrophilic polymer may be provided between the support and the dye layer in the dye donating material, which improves the transfer concentration of the dye.

With the thermal transfer dye donating material of the preferable embodiment of the present invention thus prepared, a color image can be formed with sharpness, high resolution, and high gradation. When the dye donating material is superposed on a known thermally transferred image receiving material and is heated from either one side of the materials, preferably from the side of dye donating material, by a heating means such as a thermal head in accordance with an image signal, the dye migrates from the layer for thermal transfer printing to the receiving layer of the thermally transferred image receiving material with a receiving low energy, depending on the quantity of the heating energy.

The above-mentioned thermally transferred image receiving material comprises a suitable support on which a layer of polymer or resin capable of receiving a dye image is provided.

A dye image receiving layer is established on the thermal transfer image receiving material. This receiving layer has the action of taking up the dye which migrates from the thermal transfer dye donating material during printing and fixing the dye. In practice, the use of a receiving film of a thickness of from 3 μm to 50 μm which contains a synthetic resin of the type described below is preferred. The synthetic resin preferably has an average molecular weight of 5,000 to 100,000.

(i) Resins which have Ester Bonds

Examples include polyester resins, poly(acrylic acid ester) resins, polycarbonate resins, poly(vinyl acetate) resins, styrene acrylate resins and vinyltoluene acrylate resins.

Preferred polyester resins contain anionic groups and have phenyl groups in the main chain. In this context, an anionic group is a group which displays anionic properties in a polyester resin, and those which take the form of a metal salt are preferred.

(1) Polyesters which contain anionic groups can be broadly classified as those containing anionic groups in the dicarboxylic acid moieties from which the polyester is formed, and those containing anionic groups in the diol moieties from which the polyester is formed.

Groups such as $-COO^{\ominus}$ and $-SO_3^{\ominus}$ are preferred as anionic groups.

Specific examples are indicated below. Here, the anionic group is represented by a sulfonic acid group, but the same effect can be achieved using other anionic groups.

(a) Polyesters which have anionic groups in the dicarboxylic acid of the polyester.

Those in which anionic groups are present in an isophthalic acid moiety:

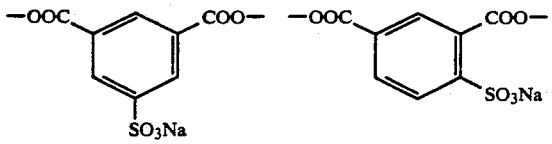

Those in which anionic groups are present in a terephthalic acid moiety:

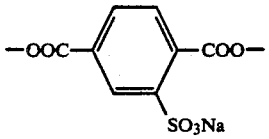

Those in which anionic groups are present in a long chain carboxylic acid ($-OOC-(CH_2)_n-COO-$, where $n \geqq 3$):

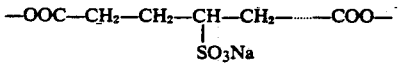

Those in which anionic groups are present in the diol moiety of the polyester are described below.

Those in which anionic groups are present in bisphenol A:

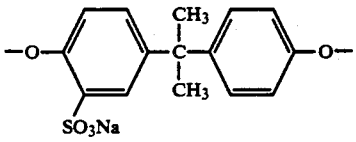

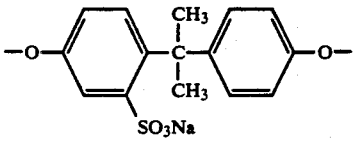

Those in which anionic groups are present in a long chain diol ($-O-(CH_2)_n-O-$, where $n \geqq 3$):

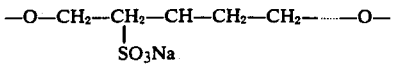

(2) Polyesters containing phenyl groups in the linear chain can be broadly classified as those containing phenyl groups in the dicarboxylic acid moieties from which the polyester is formed and those containing phenyl groups in the diol moieties from which the polyester is formed.

(a) Examples in which phenyl groups are present in the linear chain in the dicarboxylic acid of the polyester are shown below.

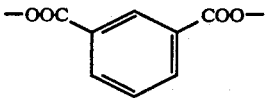

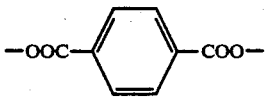

(b) Examples in which phenyl groups are present in the diol moiety are shown below.

Bisphenol A
Bisphenol B
Bisphenol AF
Bisphenol S

The use of polyesters containing phenyl groups in the diol components is preferred.

The use of polyesters containing phenyl groups in the diol components and anionic groups in the dicarboxylic acid components is especially preferred.

Furthermore, "Vylon 280", "Vylon 290" and "Vylon 300" made by Toyobo Co., Ltd, and "Kao B" and "Kao C" made by Kao can be used and are commercially available products.

(ii) Resins which have Urethane Bonds
For example, polyurethane resins.

(iii) Resins which have Amide Bonds
For example, polyamide resins.

(iv) Resins which have Urea Bonds
For example, urea resins.

(v) Resins which have Other Highly Polar Bonds
For example, polycaprolactone resins, styrene/maleic anhydride resins, poly(vinyl chloride) resins and polyacrylonitrile resins.

The synthetic resins described above can be used alone, or they can also be used in the form of mixtures or copolymers thereof.

Furthermore, the receiving layer can be formed from two or more types of resin which have different properties.

Moreover, the receiving layer may take the form of a film comprising a dispersion of a water soluble polymer and the above described resins. The use of a dispersion of the polyester resin and gelatin is especially effective.

Also, the receiving layers can be formed containing fine silica powder in addition to the resins described above.

In this context, silica signifies silicon dioxide or a substance containing silicon dioxide as the principal component. A silica of an average particle size from 10 to 100 mμ and of a specific surface area less than 250 $m^2/g$, and preferably of an average particle size from 10 to 50 mμ and of a specific surface area from 20 to 200 $m^2/g$, can be used for the fine silica powder which is present in the receiving layer.

Furthermore, the amount of fine silica powder present is within the range from 5 to 20 wt%, and preferably within the range from 5 to 10 wt%, based on the weight of the receiving layer.

These fine silica powders may be added beforehand to the resins which are used to form the receiving layers and the receiving layers can be formed by coating and drying a resin mixture solution obtained in this manner on the support.

Release agents can be present in the receiving layers of the thermal transfer image receiving materials of the present invention to improve the release properties from the thermal transfer dye donating material. Solid waxes, such as polyethylene wax, amide wax or Teflon powder, surfactants such as fluorinated and phosphate ester based surfactants; and silicone oils can be used as release agents, but the use of silicone oils is preferred.

Various silicone oils (i.e. silicone oils ranging from dimethylsilicone oil to modified silicone oils in which various organic groups have been introduced into dimethylsiloxane) can be used for the above mentioned silicone oil. For example, the use of the various modified silicone oils described in Technical Data Sheet P6-18B entitled "Modified Silicone Oils", published by the Shinetsu Silicone Co., Ltd. is effective for this purpose.

High boiling point organic solvents and thermal solvents can be used in the present invention to obtain higher transfer densities.

Esters (for example, phthalate esters, phosphate esters and fatty acid esters), amides (for example, fatty acid amides and sulfoamides), ethers, alcohols, paraffins and silicone oils which are liquids at normal temperatures and which do not volatalize at the heating temperature are preferred as high boiling point organic solvents. The high boiling point organic solvents preferably have a boiling point of at least 180° C., particularly at least 200° C., at a atmospheric pressure.

Compounds which have various properties, which is to say (1) which are compatible with the dyes, (2) which are solids at normal temperature but which melt (which may involve mixed melting with another component) when heated by the thermal head during transfer, and (3) which are not decomposed by heat from the thermal head can be used as the thermal solvents. Preferred compounds have a melting point of from 35° C. to 250° C., and most desirably of from 35° C. to 200° C., and are materials where the value of the ratio (inorganic nature-/organic nature) has a value of less than 1.5. Here, the designation of an inorganic nature and an organic nature is a concept used for estimating the nature of compounds, and this has been described in detail, for example, in *The Realm of Chemistry,* 11, page 719 (1957). In practice, use can be made of the compounds disclosed in JP-A-62-136646.

The high boiling point organic solvents and/or thermal solvents may be present alone in the form of a micro-dispersion in the receiving layer or they may be present as mixtures with other components such as a binder, for example.

The above described high boiling point organic solvents may also be used to improve slip properties, anti-stick properties and peeling properties, and to improve curl balance. A high boiling point organic solvent may also be present in the form of oil droplets where the receiving layer contains a hydrophilic binder.

Anti-color fading agents can also be present in the thermal transfer image receiving materials of the present invention. Antioxidants, ultraviolet absorbers and various metal complexes can be used as anti-color fading agents.

Examples of antioxidants include chroman based compounds, coumarane based compounds, phenol based compounds (for example, hindered phenols), hydroquinone derivatives, hindered amine derivatives and spiroindane derivatives.

Benzotriazole based compounds (for example, those disclosed in U.S. Pat. No. 3,533,794), 4-thiazolidone based compounds (for example, those disclosed in U.S. Pat. No. 3,352,681), benzophenone based compounds (for example, those disclosed in JP-A-46-2784), and other compounds disclosed, for example, in JP-A-54-48535, JP-A-62-136641 and JP-A-61-88256 can be used as ultraviolet absorbers.

The compounds disclosed, for example, in U.S. Pat. No. 4,241,155, columns 3–36 of U.S. Pat. No. 4,245,018, columns 3–8 of U.S. Pat. No. 4,254,195, JP-A-62-174741, pages 27–29 of JP-A-61-88256, Japanese Patent Application Nos. 62-234103 and 62-31096 (corresponding to JP-A-1-75568 and JP-A-63-199248, respectively), and Japanese Patent Application No. 62-230596 can be used as metal complexes.

The above mentioned antioxidants, ultraviolet absorbers and metal complexes may be used alone or in combination, if desired.

Moreover, fluorescent whiteners can be present in the thermal transfer image receiving materials of the present invention. The incorporation of fluorescent whiteners in the image receiving materials or the supply of these materials externally, for example, from the dye donating material, is preferred. The compounds described, for example, in K. Veenkataraman, *The chemistry of Synthetic Dyes,* Volume V, Chapter 8, and those disclosed in JP-A-61-143752 are examples of suitable fluorescent whiteners. More specifically, fluorescent whiteners include stilbene based compounds, coumarin based compounds, biphenyl based compounds, benzoxazolyl based compounds, naphthalimide based compounds, pyrazoline based compounds and carbostyril based compounds.

The fluorescent whiteners can be used in combination with anti-color fading agents, if desired.

Matting agents can be present in the thermal transfer image receiving materials of the present invention. In addition to the compounds such as silicon dioxide, polyolefins, polymethacrylates, etc., disclosed on page 29 of JP-A-61-88256, benzoguanamine resin beads, polycarbonate resin beads, As resin beads, etc. disclosed, for example, in Japanese Patent Application Nos. 62-110064 and 62-110065 (corresponding to JP-A-63-274944 and JP-A-63-274953, respectively), and Japanese Patent Application No. 62-051410 can be used as matting agents.

Various film hardening agents can be present in the thermal transfer image receiving materials of the present invention.

The film hardening agents disclosed, for example, in column 41 of U.S. Pat. No. 4,678,739, JP-A-59-116655, JP-A-62-245261 and JP-A-61-18942 can be used as film hardening agents when gelatin included as a binder. More specifically aldehyde based film hardening agents (for example, formaldehyde), aziridine based film hardening agents, epoxy based film hardening agents:

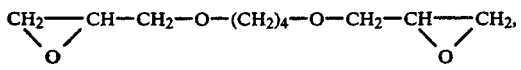

for example), vinyl sulfone based film hardening agents (for example, N,N'-ethylenebis(vinylsulfonylacetamido)ethane), N-methylol based film hardening agents (for example, dimethylol urea) or polymeric film hardening agents (the compounds disclosed, for example, in JP-A-62-234157) can be used. Furthermore isocyanate compounds can be used as film hardening agents.

Intermediate layers may be formed between the support and the receiving layers in the thermal transfer image receiving materials of the present invention.

The intermediate layers may be either cushioning layers or porous layers or diffusion resistant layers, depending on the material from which the layer is formed, or they may fulfill the role of an adhesive depending on the particular case.

Polymers which satisfy the above described conditions are indicated below.

Polyurethane resins
Polyester resins
Polybutadiene resins
Poly(acrylic acid ester) resins
Epoxy resins
Polyamide resins
Rosin modified phenolic resins
Terpene/phenol resins
Ethylene/vinyl acetate copolymer resins Examples of hydrophilic binders include natural products including proteins such a gelatin or gelatin derivatives, cellulose derivatives, and polysaccharaides such as starch, gum arabic, dextran and pullulan, and poly(vinyl alcohol), polyvinylpyrrolidone, acrylamide polymers and other synthetic polymer materials.

The above described resins can be used individually or in the form of mixtures of two or more types of resin, if desired.

Layers used as porous layers include (1) layers where a liquid comprising an emulsion of a synthetic resin, such as a polyurethane, for example, or a synthetic rubber latex, such as a methyl methacrylate/butadiene based synthetic rubber ratex, which has been agitated mechanically to incorporate bubbles thereinto is coated onto a support and dried, (2) layers where a liquid obtained by mixing a forming agent with the above mentioned synthetic resin emulsions or synthetic rubber latexes is coated onto the support and dried, (3) layers where a liquid obtained by mixing a foaming agent with a vinyl chloride plastisol, a synthetic resin such as a polyurethane or a synthetic rubber such as a styrene/butadiene based synthetic rubber is coated onto a support and foamed by heating, and (4) layers where a liquid mixture comprising a solution obtained by dissolving a thermoplastic resin or a synthetic rubber in an organic solvent and an non-solvent (including those consisting principally of water) which is less volatile than the organic solvent and compatible with the organic solvent and where the thermoplastic resin or synthetic rubber is not soluble, is coated onto a support and dried to form a film where the nonsolvent has aggregated in a micro form to provide a microporous layer.

Layers which contain gelatin as the principal component are preferred for the intermediate layers.

The above described intermediate layers may be formed on both sides of the thermal transfer image receiving material where receiving layers are present on both sides, or on just one side of the base sheet. Furthermore, the thickness of an intermediate layer is from 0.5 to 50 μm, and most desirably from 2 to 20 μm.

An anti-static agent can be present in the receiving layer on at least one side, or at the surface of the receiving layer, of the thermal transfer image receiving material of the present invention. Examples of anti-static agents include surfactants, for example, cationic surfactants (for example, quaternary ammonium salts, polyamine derivatives), anionic surfactants (for example, alkylphosphates), amphoteric type surfactants, nonionic surfactants, and fluorine based surfactants.

Any support which is able to withstand the transfer temperature, and has the appropriate smoothness, whiteness, slip properties, wear properties, anti-static properties and post transfer indentation properties, can be used as the support in the thermal transfer image receiving material of the present invention. Useful of such supports include synthetic paper supports (such as polyolefin and polystyrene based synthetic papers), paper supports such as top quality paper, art paper, coated paper, cast coated paper, wall paper, lining paper, synthetic resin or emulsion impregnated paper, synthetic rubber latex impregnated paper, synthetic resin added paper, cardboard, cellulose fiber paper, polyolefin coated paper (especially papers which have been coated on both sides with polyethylene), various plastic films or sheets such as films of polyolefins, poly(vinyl chloride), poly(ethylene terephthalate), polystyrene, methacrylate or polycarbonate, and films or sheets in which these plastics have been treated in such a way as to provide them with white reflection properties. Laminates obtained with optional combinations of the above noted supports can also be used.

In a preferred embodiment of the present invention, the dye donating material of thermal transfer printing is in a form of a sheet, a continuous ribbon or a roll. On the material, only a layer of the cyan dye of the present invention need be provided. Alternatively, additional layers of known yellow, magenta, and optionally black colors may separately be provided. In a preferred embodiment, color material layers containing independently a thermally migrating dye of yellow, magenta, or cyan (or black if necessary), namely regions of yellow, magenta, or cyan (or black if necessary) are sequentially arranged to construct a thermal transfer dye donating material.

In full color recording with such a thermal transfer dye donating material, for example, in a cyan color material layer (a cyan region) being presscontacted to a thermally transferred image receiving material, heat pattern is generated at the head elements of the thermal head in accordance with the cyan color signal corresponding to the picture elements of one scanning line. The cyan dye in the color material is transferred to the receiving layer of the thermally transferred image receiving material. This operation is conducted by moving the dye donating material and the image receiving material, thereby completing the transfer of cyan color for the picture.

On the same picture, the transfer treatments are conducted sequentially with yellow and magenta colors (and black color if necessary). Apparatuses for this recording are known. See, for example, JP-A-62-1585.

The dye of the present invention is applicable to dye donating materials for thermal transfer printing other than that for a thermally migrating transfer printing. In a second preferred embodiment of the present invention, the thermal transfer layer of the thermal transfer dye donating material is a thermally fusible transfer layer comprising the dye of the present invention and a wax. The thermal transfer dye donating material in this embodiment can be prepared in such a manner that an ink for thermal transfer layer comprising a dye and a wax is prepared and a thermally fusible transfer layer is formed with the ink on one face of the above mentioned specific support. The ink may be prepared by blending and dispersing a dye in a wax having a suitable melting point such as paraffine wax, microcrystalline wax, carnauba wax, and urethane type wax. The ratio of the dye to the wax is such that the dye amounts to approximately 10 to 65% by weight of the formed thermally fusible transfer layer. The thickness of the formed layer is preferably in the range of approximately 1.5 μm to 6.0 μm. The preparation and application thereof can be carried out according to a known procedure.

The thermal transfer dye donating material of the second embodiment of the present invention will give an excellent print by transferring the thermally fusible transfer layer onto a thermally transferred image receiving material when used in the same manner as in the aforementioned first embodiment. The dye represented by the general formula (I) has a sharp cyan color, so that a combination thereof with a magenta color and a yellow color is suitable for full color recording with high color reproducibility. The dye will also give record of high color density with a high speed without an excessive load to the heating head because of its high sublimableness and a high molecular absorption coefficient. Further, the dye offers excellent storability property because the dye is resistant to heat, light, humidity, and chemicals, and is not thermally decomposed during transfer recording. Moreover, it features a reduced risk of retransferring. The dye of the present invention has a high solubility in an organic solvent and a high dispersibility in water, which facilitates preparation of the ink having a high concentration of the dye with uniform dissolution or dispersion of the dye. The use of such an ink will give a thermal transfer dye donating material which is coated uniformly with a high concentration of the dye. Accordingly, the use of such a thermal transfer dye donating material enables recording with satisfactory uniformity and color-density.

In the Example described below, the dye donating materials for thermal transfer printing were tested for printing performance.

EXAMPLE

(Preparation of the Dye Donating Material (1) for Thermal Transfer Printing)

Onto a polyethylene terephthalate film support of 6 μm thick (made by Teijin, Ltd.) (which was treated for heat resistance and lubrication on the back face), a coating composition (1) for thermal transfer dye donating material composed of the constitution as below was applied by wire bar coating so as to give a dry film thickness of 1.5 μm to prepare the dye donating material (1) for thermal transfer printing.

| Coating Composition (1) for Dye Donating Material for Thermal Transfer Printing: | |
|---|---|
| Dye (No. 1) | 5 g |
| Polyvinylbutyral Resin (Denka Butyral 5000-A, made by Denki Kagaku Kogyo K.K.) | 3 g |
| Toluene | 40 ml |
| Methyl ethyl ketone | 40 ml |
| Polyisocyanate (Takenate D110N made by Takeda Chemical Industries, Ltd.) | 0.2 ml |

Dye donating materials (2) to (5) and a comparative material (a) shown in Table 1 were prepared in the same manner as preparation of dye donating material (1) except that the dyes as indicated in Table 1 were used.

Preparation of Thermally Transferred Image Receiving Material

Onto a support of synthetic paper (YUPO-FPG-150, made by Oji Yuka Co.) having a thickness of 150 μm, the coating composition (1) for an image receiving layer was applied by wire bar coating so as to give a dried film thickness of 8 μm, forming an image receiving layer (1) for thermal transfer printing. Drying was accomplished by preliminary drying by an drier and then drying in an oven at 100° C for 30 hours.

| Coating Composition (1) for an Image receiving Layer | |
|---|---|
| Polyester Resin (Vylon-280, made by Toyobo Co., Ltd.) | 22 g |
| Polyisocyanate (KP-90, made by Dainippon Ink and Chemicals, Inc.) | 4 g |
| Amino-Modified Silicone oil (KF-857, made by Shin-etsu Silicone Co., Ltd.) | 0.5 g |
| Methyl Ethyl Ketone | 85 ml |
| Toluene | 85 ml |
| Cyclohexanone | 15 ml |

The thermal transfer dye donating material and the image receiving material for thermal transfer printing thus prepared were superposed so that the color material layer contacted the image receiving layer. Printing was accomplished with a thermal head from the side of the support for the image receiving material under the conditions of a thermal head output of 0.25 W per dot, a pulse length of 0.15 to 15 m sec, and a dot density of 6 dots/mm. Thereby, the cyan dye was fixed onto the image receiving layer of the thermally transferred receiving material, giving a sharp image-carrying material without non-uniform image transfer.

The reflection spectra of the resulting image receiving material for thermal transfer printing having been subjected to recording were measured with a Hitachi Spectrophotometer 340 provided with an integrating sphere. The difference of the wavelength at the absorption peak from the wavelength at which the absorbance is half of the peak absorbance at the shorter wavelength side was defined as the half width, which gives evaluation of the sharpness of the cyan color image.

The resulting image receiving material for thermal transfer printing was also tested for the color image stability with a light-fastness tester having 12,000 lux fluorescent lamp for 7 days. The light fastness at the light storage was evaluated by the ratio of the reflection densities through a Status A filter before and after the light storage test.

The resulting image receiving material for thermal transfer printing was tested for retransfer of the dye by superposition thereof with non-recorded image receiving material with the both image receiving sides brought into mutual contact. A weight of 5 g/cm$^2$ was applied to the material, and it was stored in an incubator kept at 60° C. for 24 hours. The increase of the dye in the unrecorded material was measured. The results are shown in Table 1.

TABLE 1

| Dye donating Material No. | Dye No. | Half Width (nm) | Transfer Density | Light-Fastness (remaining ratio) | Retransfer Density |
|---|---|---|---|---|---|
| (1) | 1 (Invention) | 80 | 1.69 | 0.87 | 0.06 |
| (2) | 7 (Invention) | 80 | 1.64 | 0.88 | 0.05 |
| (3) | 11 (Invention) | 80 | 1.33 | 0.87 | 0.05 |
| (4) | 12 (Invention) | 80 | 1.60 | 0.89 | 0.06 |
| (5) | 14 (Invention) | 82 | 1.55 | 0.88 | 0.05 |
| (a) | (a) (Comparision) | 90 | 1.60 | 0.58 | 0.31 |

Comparison dye (a) had the following structure:

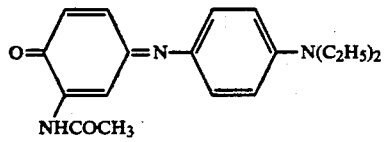

From the Table 1, it is evident that the dye of the present invention exhibits sharper absorbance, superior color reproduction and higher light-fastness, and is less likely to retransfer.

While the invention has been described in detail and with reference to specific embodiments thereof, it will be apparent to one skilled in the art that various changes and modifications can be made therein without departing from the spirit and scope thereof.

What is claimed is:

1. A thermal transfer dye donating material comprising a color material layer formed on a support, said color material layer containing a binder resin or a wax, and a dye represented by the general formula (I) below:

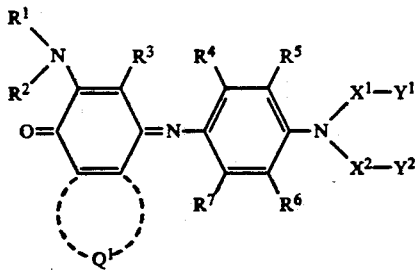

(I)

wherein $Q^1$ is an atomic group having at least one nitrogen atom and forming a five- to seven-membered nitrogen-containing heterocycle together with the carbon atoms to be bonded; $R^1$ is an acyl group, an alkoxycarbonyl group, an aryloxycarbonyl group, an aminocarbonyl group, or a sulfonyl group; $R^2$ is a hydrogen atom or an alkyl group; $R^3$ to $R^7$ are independently a hydrogen atom, an alkyl group, an alkoxy group, or a halogen atom; $X^1$ and $X^2$ are independently an alkylene group; $Y^1$ is an alkoxy group, a halogen atom, an acylamino group, an alkoxycarbonyl group, an alkoxycarbonyloxy group, a cyano group, an alkoxycarbonylamino group, an aminocarbonylamino group, a carbamoyl group, an acyloxy group, an acyl group or a hydroxy group; $Y^2$ is a hydrogen atom or groups defined above as $Y^1$.

2. The thermal transfer dye donating material of claim 1, wherein $Q^1$ comprises a nitrogen atom and a bivalent amino group, an ether group, a thioether group, an alkylene group, a vinylene group, an imino group, a sulfonyl group, a carbonyl group, an arylene group, a bivalent heterocyclic group, or a combination of the above groups.

3. The thermal transfer dye donating material of claim 1, wherein $Q^1$ represents a structure having the following formula:

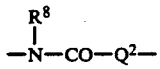

wherein $Q^2$ represents a bivalent amino group, an ether group, a thioether group, an alkylene group, a vinylene group, an imino group, a sulfonyl group, a carbonyl group, an arylene group, a bivalent heterocyclic group, or a combination of the above groups and $R^8$ represents a hydrogen atom, an alkyl group which may be substituted, an aryl group which may be substituted, or a heterocyclic group which may be substituted.

4. The thermal transfer dye donating material of claim 1, wherein $R^1$ represents an acyl group having 2 to 7 carbon atoms and $R^2$ represents a hydrogen atom.

5. The thermal transfer dye donating material of claim 1, wherein $R^3$, $R^5$, $R^6$ and $R^7$ each represents a hydrogen atom and $R^4$ represents a hydrogen atom, a methyl group, an ethyl group, a methoxy group, or an ethoxy group.

6. The thermal transfer dye donating material of claim 1, wherein at least one of, $X^1$ and $X^2$ represents an ethylene group.

7. The thermal transfer dye donating material of claim 1, wherein $Y^1$ is an alkoxy group having 1 to 4 carbon atoms, an alkoxycarbonyl group, or an acyloxy group and $Y^2$ is a hydrogen atom.

8. The thermal transfer dye donating material of claim 1, wherein the dye is represented by the general formula (II):

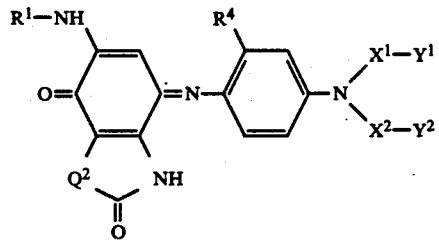

(II)

wherein $Q^2$ represents a bivalent amino group, an ether group, a thioether group, an alkylene group, a vinylene group, an imino group, a sulfonyl group, a carbonyl group, an arylene group, a bivalent heterocyclic group, or a combination of the above groups; $R^1$ is an acyl group, an alkoxycarbonyl group, an aryloxycarbonyl group, an aminocarbonyl group, or a sulfonyl group; $R^4$ is a hydrogen atom, an alkyl group, an alkoxy group, or a halogen atom; $X^1$ and $X^2$ are independently an alkylene group; $Y^1$ is an alkoxy group, a halogen atom, an acylamino group, an alkoxycarbonyl group, an alkoxycarbonyloxy group, a cyano group, an alkoxycarbonylamino group, an aminocarbonylamino group, a carbamoyl group, an acyloxy group, an acyl group or a hydroxy group; $Y^2$ is a hydrogen atom or groups defined above as $Y^1$.

9. The thermal transfer dye donating material of claim 8, wherein $Q^2$ represents a group having any of the following structures:

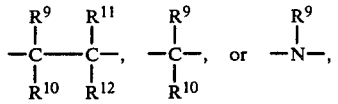

wherein $R^9$ to $R^{12}$ may be the same or different and represent independently a hydrogen atom, or an alkyl group having 1 to 4 carbon atoms.

10. The thermal transfer dye donating material of claim 1, wherein the color material layer comprises a binder resin in an amount of approximately 50 to 600 parts by weight per 100 parts by weight of the dye.

* * * * *